US006952553B2

(12) United States Patent
Sakakibara et al.

(10) Patent No.: US 6,952,553 B2
(45) Date of Patent: Oct. 4, 2005

(54) IMAGE HEATING APPARATUS AND PRESSURE ROLLER USED FOR THE APPARATUS

(75) Inventors: Hiroyuki Sakakibara, Shizuoka (JP); Yoji Tomoyuki, Tokyo (JP); Yusuke Nakazono, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/642,186

(22) Filed: Aug. 18, 2003

(65) Prior Publication Data

US 2004/0132597 A1 Jul. 8, 2004

(30) Foreign Application Priority Data

Aug. 19, 2002 (JP) ..... 2002-238100
Aug. 11, 2003 (JP) ..... 2003-207157

(51) Int. Cl.[7] ..... G03G 15/20
(52) U.S. Cl. ..... 399/328; 399/333
(58) Field of Search ..... 399/328, 329, 399/331, 333; 219/216

(56) References Cited

U.S. PATENT DOCUMENTS

| | | | | |
|---|---|---|---|---|
| 5,138,390 A | | 8/1992 | Miyabayashi et al. | |
| 5,253,024 A | | 10/1993 | Okuda et al. | |
| 5,293,202 A | | 3/1994 | Adachi et al. | |
| 5,464,964 A | | 11/1995 | Okuda et al. | 219/497 |
| 5,552,582 A | | 9/1996 | Abe et al. | 219/619 |
| 5,552,874 A | | 9/1996 | Ohtsuka et al. | |
| 5,852,763 A | | 12/1998 | Okuda et al. | 399/329 |
| 5,860,051 A | * | 1/1999 | Goto et al. | 399/329 |
| 6,709,373 B2 | * | 3/2004 | Park | 492/56 |
| 6,763,205 B2 | * | 7/2004 | Izawa et al. | 399/69 |
| 2002/0127035 A1 | | 9/2002 | Otsuka et al. | 399/329 |

FOREIGN PATENT DOCUMENTS

| | | |
|---|---|---|
| JP | 4-44075 | 2/1992 |
| JP | 4-44076 | 2/1992 |
| JP | 4-44077 | 2/1992 |
| JP | 4-44078 | 2/1992 |
| JP | 4-44079 | 2/1992 |
| JP | 4-44080 | 2/1992 |
| JP | 4-44081 | 2/1992 |
| JP | 4-44082 | 2/1992 |
| JP | 4-44083 | 2/1992 |
| JP | 4-204980 | 7/1992 |
| JP | 4-204981 | 7/1992 |
| JP | 4-204982 | 7/1992 |
| JP | 4-204983 | 7/1992 |
| JP | 4-204984 | 7/1992 |
| JP | 9-114281 | 5/1997 |
| JP | 2000-143986 | 5/2000 |
| JP | 2002-114860 | 4/2002 |

* cited by examiner

*Primary Examiner*—William J. Royer
(74) *Attorney, Agent, or Firm*—Fitzpatrick, Cella, Harper & Scinto

(57) ABSTRACT

A pressure roller has a metal core, an elastic layer of cured rubber composition at least containing a water-absorbing polymer containing water and a surface releasing layer laminated on an outer periphery of the metal core. A compression amount (y) of the elastic layer satisfies the following relationship: $y \leqq 0.8$ (mm).

20 Claims, 6 Drawing Sheets

IMAGE HEATING APPARATUS AND PRESSURE ROLLER USED FOR THE APPARATUS

BACKGROUND OF THE INVENTION

1. Field of the Invention

The present invention relates to an image heating apparatus preferably used for a heat-fixing device mounted on an image forming apparatus such as a copying machine and a printer, and a pressure roller used for the image heating apparatus.

2. Related Background Art

Recently, in a business machine field, a product having small electric power consumption has been demanded. As for an image forming apparatus such as a copying machine employing an electrophotographic system or a laser beam printer, an attempt of reducing heat capacity of a heat-fixing device has been made in order to suppress electric power consumption. As an on-demand heat-fixing device, a ceramic heater type device, an electromagnetic induction type apparatus, or the like has been practically used. The ceramic heater type device includes a ceramic heater arranged in a film-shaped rotary member, and a pressure roller cooperating with the ceramic heater through the film-shaped rotary member to constitute a heating nip portion, and heats an image on a recording material with heat of the ceramic heater while transporting the recording material in the heating nip portion. According to the electromagnetic induction type device, a film-shaped rotary member or a fixing roller generates heat by itself.

In the above-mentioned background, as a result of further progress of shortening in a so-called first print time and energy saving, shortening of rising time of a heating operation and reduction of electric power consumption of a fixing device have been especially demanded.

Therefore, "heat insulating property" has been recently desired as an especially important function to be required for the pressure roller used in the heat-fixing device.

This is based on a concept which reduces heat conductivity of an elastic layer of the pressure roller so as to suppress quantity of heat taken away from a heating member by the pressure roller at the time of starting the operation of the heat-fixing device, thereby improving a temperature increasing rate of the film-shaped rotary member or the fixing roller in contact with the pressure roller.

Therefore, it has become the most important issue to use a material having low heat conductivity for a heat resistant elastic layer constituting the pressure roller.

An example of a material achieving low heat conductivity of the heat resistant elastic layer includes silicone rubber foam utilizing low heat conductivity of gas.

Furthermore, a pressure roller having excellent heat insulating property, which contains a hollow filler in an elastic layer thereof, is proposed, for example, in Japanese Patent Application Laid-open No. 09-114281.

In addition, a pressure roller containing a resin microballoon in an elastic layer has been already proposed in Japanese Patent Application Laid-open No. 2000-143986.

However, while such a pressure roller is capable of achieving reduction of heat conductivity, it simultaneously has the following problems.

For example, a method of adding a heat decomposition type foaming agent to silicone rubber, and a method of generating a foam using hydrogen gas as a foaming agent which is a by-product at the time of curing are known as a method of producing silicone rubber foam utilizing low heat conductivity of gas. These methods have difficulty of forming a finely and evenly foamed cell. As a result, since surface smoothness of the foam is insufficient, there arises a problem in that the pressure roller is contaminated by a toner.

Here, the surface smoothness and the toner contamination of the pressure roller will be described in detail. In general, a mold releasing layer (e.g., a fluororesin tube or a fluororesin coating) is provided on an outer peripheral surface of the elastic layer in order to prevent the toner contamination of the pressure roller. Since thickness of the mold releasing layer is approximately several tens of $\mu$m, the surface smoothness of the roller depends on smoothness of the elastic layer. If there exist convex and concave portions on the surface of the elastic layer, which forms convex and concave portions on the surface of a surface releasing layer. As a result, a contaminant toner is deposited on the concave portion of the surface releasing layer. Therefore, it is preferred that the elastic layer has a sufficient surface smoothness.

The applicant of the present invention has already proposed that hardness of a minute area on the mold releasing layer surface is a factor related to toner contamination of the pressure roller and that the hardness is preferably low. In other words, it is not effective to increase the thickness of the mold releasing layer as a technique for improving the surface smoothness because the toner contamination of the pressure roller would be increased unwillingly.

As for a method of adding the hollow filler into the silicone rubber, the hollow filler reduces heat conductivity by providing a gas portion to a cured product like sponge rubber. Therefore, it is possible to improve the surface smoothness by using a hollow filler having a small particle diameter.

In the case where an inorganic hard filler is used as a hollow filler, if the hard filler is added in such an adjusted amount as to enable desired reduction of a heat conductivity, a hardness of the pressure roller becomes excessively large. As a result, a fixing nip width with which a satisfactory fixing property is achieved cannot be obtained.

In the case where a hollow filler having elasticity by itself (i.e., a resin hollow balloon) is used, the resin hollow balloon is broken during use (endurance). As a result, problems such as compression set and reduction of hardness during endurance would be caused.

In consideration of the above-mentioned problems, a method of producing a foam, which enables a finely foamed cell without using a hollow filler, is disclosed in Japanese Patent Application Laid-open No. 2002-114860.

This method includes mixing a water-absorbing polymer containing water in silicone rubber and evaporating a water content at the time of heat-curing the rubber so as to form a foamed cell (bubble) in a silicone rubber elastic layer (hereinafter, the method is referred to as "water evaporation foaming method"). This method has advantages that a foamed cell size can be controlled by varying a particle diameter of the water-absorbing polymer in a powder form and a content of the water, so that a fine cell can be obtained.

A pressure roller obtained by the water evaporation foaming method exhibits an extremely high open-cell rate, in the case of suppressing the heat conductivity of the elastic layer, although it depends on a blending amount of a water-absorbing polymer. In the case of a foam using a water-absorbing polymer, since a cell is formed by evaporation of the water content in a heat-curing process, the cell in the obtained foam does not have a wall such as that of a hollow filler. Since the cell itself does not have a wall, an increase of the blending amount of the water-absorbing polymer results in that the cells after heat-curing are coupled to each other to have an open-cell property. If an expansion ratio of the foam is increased in order to further reduce heat conductivity, a border portion amount of the foamed cells becomes thin and the foam exhibits a high open-cell rate, thereby causing a functional deterioration such as deterioration of impact resilience which is inherent in rubber.

In the case where a low heat capacity film unit is used as a unit opposing a pressure roller, in order to simplify an apparatus structure, only a regulating member mounted on each of left and right sides of a fixing film regulates displacement of the fixing film in a left or right direction. As a result, if a pressure roller having deteriorated impact resilience (i.e., grip) is used, the regulating property for suppressing the displacement of the fixing film in the left or right direction also deteriorates. As a result, the rupture of the end portion of the fixing film of the item (2) would be caused.

SUMMARY OF THE INVENTION

The present invention has been made in view of the above-mentioned problems. Therefore, it is an object of the present invention to provide an image heating apparatus capable of rapidly increasing a temperature to a desired temperature.

It is an another object of the present invention to provide a pressure roller having low heat conductivity without deteriorating rubber elasticity and an image heating apparatus using such a pressure roller.

It is still another object of the present invention to provide an image heating apparatus, including:

a heating member; and a pressure roller forming a nip portion together with the heating member, the pressure roller having an elastic layer and a surface releasing layer (mold releasing layer), and the nip portion nipping and transporting the recording material, in which the elastic layer of the pressure roller includes a foam obtained by heat-curing a rubber composition in which a water-absorbing polymer containing water and a hollow filler are dispersed.

It is still another object of the present invention to provide a pressure roller, including:

an elastic layer; and a surface releasing layer, in which the elastic layer includes a foam obtained by heat-curing a rubber composition in which a water-absorbing polymer containing water and a hollow filler are dispersed.

It is still another object of the present invention to provide an image heating apparatus, including:

a heating member; and a pressure roller forming a nip portion together with the heating member, the pressure roller having an elastic layer and a surface releasing layer, and the nip portion nipping and transporting the recording material, in which the elastic layer of the pressure roller includes a foam obtained by heat-curing a rubber composition in which a water-absorbing polymer containing water is dispersed, and in which the pressure roller has a compression amount of 0.8 mm or less.

It is still another object of the present invention to provide a pressure roller, including:

an elastic layer; and a surface releasing layer, in which the elastic layer includes a foam obtained by heat-curing a rubber composition in which a water-absorbing polymer containing water is dispersed, and in which the pressure roller has a compression amount of 0.8 mm or less.

Further other objects of the present invention would become apparent by reading the following detailed description with reference to accompanying drawings.

BRIEF DESCRIPTION OF THE DRAWINGS

DESCRIPTION OF THE PREFERRED EMBODIMENTS (1) Example of Image Forming Apparatus FIG. 1 is a schematic structural view illustrating an example of an image forming apparatus. The image forming apparatus of this embodiment is a laser beam printer employing a transfer type electrophotographic process.

Figure 1:
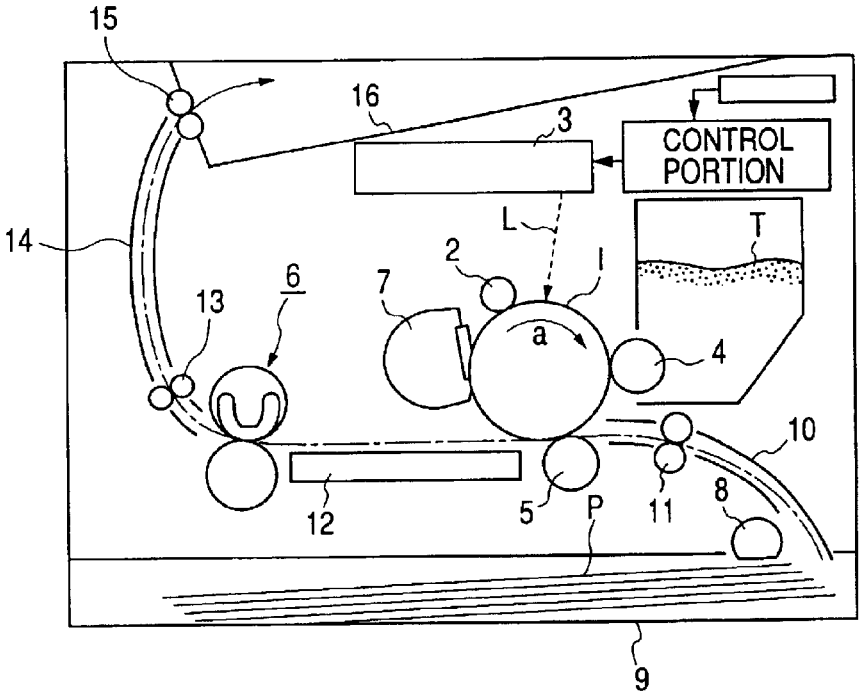
FIG. 1 is a schematic structural view illustrating an example of an image forming apparatus.

Reference numeral 1 denotes a rotary drum type electrophotographic photosensitive member (hereinafter, referred to as "photosensitive drum") as an image bearing member, which rotates in a clockwise direction indicated by the arrow a at a predetermined peripheral velocity (process speed). The photosensitive drum 1 includes a photosensitive material layer composed of OPC, amorphous Se, amorphous Si or the like formed on an outer peripheral surface of a cylindrical (drum-shaped) conductive base composed of aluminum, nickel or the like.

The photosensitive drum 1 is subjected to a charging treatment during rotation by a charging roller 2 which is charging means, so as to be evenly charged at predetermined polarity and potential. The evenly charged surface of the rotary photosensitive drum 1 is subjected to a scanning exposure L with a laser beam modulatedly controlled (ON/OFF controlled) corresponding to a time-sequential electrical digital pixel signal of desired image information, the laser beam being outputted from a laser beam scanner 3. As a result, an electrostatic latent image corresponding to the desired image information is formed on the surface of the rotary photosensitive drum 1.

The formed latent image is developed by a toner T in a developing apparatus 4 to be visualized. As a developing method, a jumping developing method, a two-component developing method, a FEED developing method or the like is used. In many cases, a combination of an image exposure and a reversal developing is used.

On the other hand, a sheet of a transfer material P (being a recording material) received in a sheet feed cassette 9 is sent out by drive of a sheet feed roller 8. The sheet is fed through a sheet path having a guide 10 and registration rollers 11 to a transfer nip portion which is a press-contacting portion between the photosensitive drum 1 and a transfer roller 5 at a predetermined controlled timing. As a result, a toner image on the photosensitive drum 1 is successively transferred to the surface of the fed transfer material P.

The transfer material P having passed the transfer nip portion is successively separated from the surface of the photosensitive drum 1 and is introduced to a heat-fixing device 6 (being a heating apparatus) by a transporting apparatus 12, so as to be subjected to a heat-fixing treatment of the toner image. The heat-fixing device 6 will be described in detail in item (2) described later.

The transfer material P having passed the heat-fixing device 6 is transported through a sheet path having transporting rollers 13, a guide 14, and delivery rollers 15 to be transported out to a delivery tray 16.

Furthermore, the surface of the rotary photosensitive drum 1 after the transfer material P separation therefrom is cleaned by a cleaning apparatus 7 so that contaminants such as transfer residual toner attached on the surface are removed. Then, the photosensitive drum 1 is used for a next image forming process.

In this embodiment, used is an image forming apparatus having a print speed of 18 sheets/minute (for A4 size), a first print time of 10 seconds, and a time from print signal input to entering of a sheet into a fixing nip portion of 6 seconds.

(2) Heat-fixing Device 6

Figure 2:
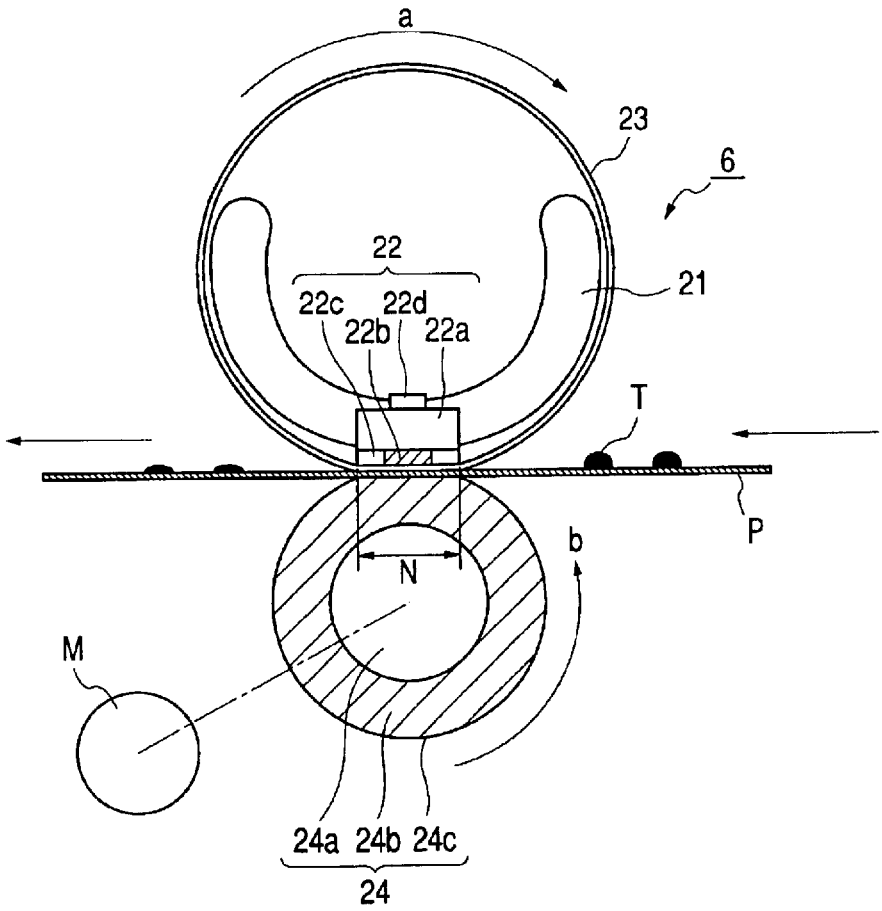
FIG. 2 is a schematic structural view illustrating a heat-fixing device.

FIG. 2 shows a schematic structure model of a heat-fixing device 6 as a heating apparatus used in this embodiment. The heat-fixing device 6 according to this embodiment is a heating apparatus employing a so-called tensionless type film heating system and a pressurizing rotary member (pressure roller) driving system, as described in Japanese Patent Application Laid-open No. 04-044075 to Japanese Patent Application Laid-open No. 04-044083, Japanese Patent Application Laid-open No. 04-204980 to Japanese Patent Application Laid-open No. 04-204984 and the like.

Reference numeral 21 denotes an oblong film guide member (stay) having a substantially semicircular arc gutter vertical cross-section with a direction perpendicular to the drawing sheet being defined as a longitudinal direction; reference numeral 22 denotes an oblong heating member received and held in a groove which is formed on almost the center portion of the lower surface of the film guide member 21 along the longitudinal direction; and reference numeral 23 denotes a heat resistant film having an endless belt shape (cylindrical shape), which is loosely fitted into the film guide member 21 provided with the heating member 22. Those members 21 to 23 are collectively referred to as a member on the heating member side.

Reference numeral 24 denotes an elastic pressure roller (as a pressurizing member) which is press contacted with the lower surface of the heating member 22 while nipping the film 23 therebetween. Character N denotes a press-contacting nip portion (fixing nip portion) which is formed between the pressure roller 24 and the heating member 22 by elastic deformation of an elastic layer 24*b* of the pressure roller 24 being press contacted with the heating member 22 while nipping the film 23 therebetween. The pressure roller 24 is rotated in a counter-clockwise direction indicated by the arrow b at a predetermined peripheral velocity, by a driving force of a driving source M transmitted through a power transmission device (not shown) such as a gear.

The film guide member 21 is a molded product composed of a heat resistant resin such as polyphenylenesulfide (PPS) or a liquid crystal polymer.

In this embodiment, the heating member 22 is an entirely low heat capacity ceramic heater which includes: an oblong and thin plate-shaped heater substrate 22*a* made of alumina or the like; a line or narrow belt-shaped electric heater generating member (resistance heat generating member) 22*b* provided on the front surface (film sliding side) of the substrate 22*a* and made of Ag/Pb alloy or the like; a thin surface protect layer 22*c* such as a glass layer; and a temperature detecting device 22*d* such as thermistor provided on the back surface of the substrate 22*a*. A temperature of the heating member 22 is rapidly increased by electric power supply to the electric heat generating member 22*b*, and is controlled at a predetermined fixing temperature by an electric power controlling system including the temperature detecting device 22*d*.

A total thickness of the heat resistant film 23 is 100 $\mu$m or less and preferably 20 to 60 $\mu$m to make heat capacity small and to improve a quick start property. An example of the film 23 includes: a single layer film of polytetrafluoroethylene (PTFE), tetrafluoroethylene-perfluoroalkylvinylether (PFA), PPS or the like having heat resistance, mold releasing property, mechanical strength and durability; or a layered film having a mold releasing layer (composed of PTFE, PFA, of FEP) or the like) coated on a base film (composed of polyimide, polyamideimide, polyetheretherketone (PEEK), polyethersulfone (PES) or the like).

The pressure roller 24 includes a metal core 24*a* of iron, aluminum or the like, and the elastic layer 24*b* obtained by using a material and a production method described in detail in item (3) later.

A rotation driving force, which is a frictional force between the pressure roller 24 and the outer surface of the film 23 in the press-contacting nip portion N, is applied to the film 23 by rotation of the pressure roller 24 in the counter-clockwise direction indicated by the arrow b at least at the time of performing image formation. As a result, the film 23 is rotated in the clockwise direction indicated by the arrow a along the outer circumference of the film guide member 21 at a predetermined peripheral velocity (specifically a peripheral velocity nearly the same as a transporting speed of a transfer material P bearing an unfixed toner image T transported from an image transferring portion), while an inner surface of the film 23 being slid in close contact with the lower surface (front surface) of the heating member 22 in the press-contacting nip portion N. In this case, a lubricant such as heat resistant grease is preferably interposed between the inner surface of the film 23 and the lower surface of the heating member 22 on which the film 23 slides to reduce a slide resistance therebetween.

As described above, the film 23 is rotated by rotation of the pressure roller 24. Furthermore, under a condition that the temperature of the heating member 22 is controlled at the predetermined fixing temperature, the transfer material P (as a material to be heated) bearing the unfixed toner image T is introduced to a portion between the pressure roller 24 and the film 23 in the press-contacting nip portion N while the surface on which the unfixed toner image T is born being faced to the film 23. Then, the transfer material P is closely contacted with the outer surface of the film 23, and nipped and transported together with the film 23 in the press-contacting nip portion N. As a result, the unfixed toner image T is heat and press-fixed on the surface of the transfer material P by being provided with heat of the heating member 22 through the film 23 and by being pressurized by the press-contacting nip portion N. The transfer material P having passed the press-contacting nip portion N is separated from the outer surface of the film 23 and transported.

Since the heating apparatus 6 employing a film heating system according to this embodiment is capable of using the heating member 22 having a small heat capacity and a rapid temperature increase, it is possible to drastically shorten a time necessary for the temperature of the heating member 22 to reach the predetermined temperature. Therefore, since it is possible to easily increase temperature from an ordinary temperature to a high temperature, temperature control at a standby condition (i.e., at the time of no printing) is not required, thereby suppressing electric power consumption.

Furthermore, since substantially no tension is applied to the rotating film 23 except in the press-contacting nip portion N and the heating apparatus 6 is preferably simplified, only a flange member which simply catches an end portion of the film 23 is provided as means that regulates displacement of the film 23.

(3) Pressure Roller 24

As for the pressure roller 24 in the heat-fixing device 6, a material constituting the roller 24, a molding method or the like will hereinafter be described in detail.

1) Layer Structure of the Pressure Roller 24

Figure 3:
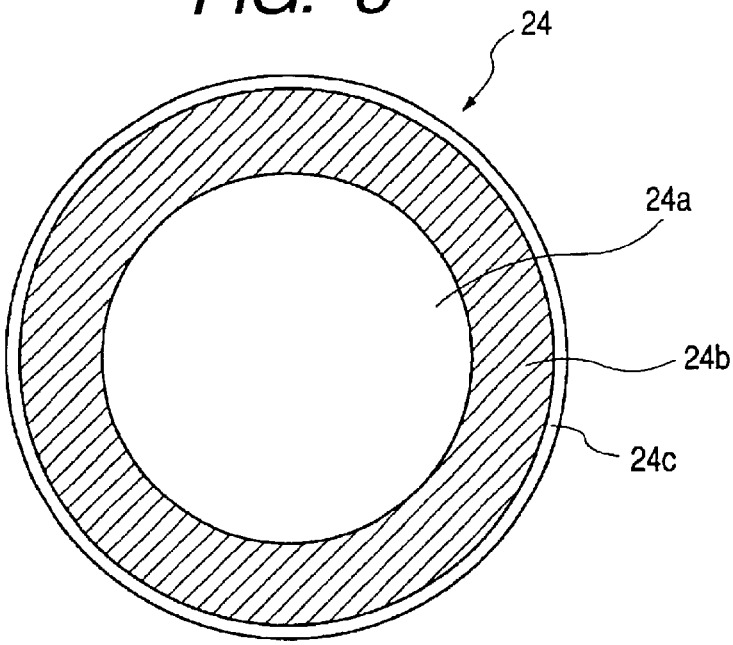
FIG. 3 shows a layer structure model of a pressure roller.

FIG. 3 is a layer structure model of a pressure roller 24.

The pressure roller 24 includes the metal core 24*a* and at least (a) the elastic layer 24*b* composed of a cured rubber composition containing a water-absorbing polymer containing water therein and (b) a mold releasing layer 24*c* composed of fluororesin or fluoro rubber laminated on the elastic layer, on an outer peripheral of the metal core 24*a*. Here, a compression amount y of the elastic layer 24*b* satisfies the following relationship:

$$y \leqq 0.8 \text{ (mm)}.$$

(a) Elastic layer 24*b*.

It has been found that a quantity of heat taken away from the heating member 22 by the pressure roller 24 at the time of operating the heat-fixing device 6 can be suppressed by setting a heat conductivity of the elastic layer 24*b* of the pressure roller 24 to be 0.15 w/m·k or less. It is also possible to improve a temperature increasing rate on the surface of the film 23 and therefore to permit a so-called quick start of the heat-fixing device 6 by setting the heat conductivity of the elastic layer 24*b* of the pressure roller 24 to be 0.15 w/m·k or less. If the heat conductivity is less than 0.084 w/m·k, a temperature increasing rate on the surface of the film 23 becomes large and therefore fixing property is improved. However, in this case, since temperature increase in a no-paper feeding portion becomes excessively large in the case of feeding small size paper, more satisfactory heat resistance is required for the pressure roller 24. Therefore, the heat conductivity of the elastic layer 24*b* is preferably in the range of 0.084 to 0.15 w/m·k. Measurement of the heat conductivity of the elastic layer 24*b* will be described later.

A thickness of the elastic layer 24*b* used in the pressure roller 24 is not specifically limited so long as a press-contacting nip portion N having a desired width can be formed. However, the thickness is preferably 2 to 10 mm.

In this embodiment, details about the material constituting the elastic layer 24*b* are not specifically limited so long as the elastic layer 24*b* is composed of a foam which is obtained by heat-curing a rubber composition containing a water-absorbing polymer containing water therein and a heat conductivity of the elastic layer 24*b* is in the range of 0.084 to 0.15 w/m·k.

Preferred examples of the water-absorbing polymer include: polyacrylic acid and alkali metal salt thereof, and cross-linked polymer thereof; and starch-acrylic acid graft copolymer and alkali metal salt thereof. Cross-linked partial sodium salt of polyacrylic acid, and partial sodium salt of starch-acrylic acid graft copolymer are especially preferred.

A water-absorbing polymer in a powder form is used to incorporate water therein. An average particle diameter of the water-absorbing polymer is an important factor for determining a cell (bubble) diameter of the elastic layer 24*b* (foam) because a foamed elastic layer 24*b* is formed by evaporating water content in the polymer in the heat-curing process described later. An average particle diameter of the water-absorbing polymer in a powder form (in a dried condition) is preferably 10 to 250 $\mu$m, more preferably 10 to 100 $\mu$m, and especially preferably 20 to 50 $\mu$m. An average particle diameter of the water-absorbing polymer in a water-containing condition is preferably 10 to 500 $\mu$m.

In the case of designing especially low heat conductivity, both the cell diameter and cell density should be designed to be large in the process of forming a cell by evaporating water content from the water-absorbing polymer containing water. As a result, since a border portion of the cells would be thin, rubber elasticity (impact resilience) may be deteriorated.

It is experimentally confirmed that, in such a case, rubber elasticity (impact resilience) can be improved by blending a hard balloon in the rubber composition. It is conceivable that the blended hard balloon functions as a core and increases rubber elasticity (impact resilience) of the rubber in the vicinity of the balloon.

Therefore, an inorganic balloon and an impact modified resin balloon containing an inorganic filler attached thereon is preferably used alone or in combination in the case where the balloons are used to be mixed with the water-absorbing polymer containing water, while there are various kinds of hollow balloons (and hollow fillers) such as an inorganic balloon or an organic resin balloon.

Examples of the inorganic hard balloon include a silica balloon, a glass balloon, a carbon balloon, an alumina balloon, and a shirasu balloon each having a diameter of 1 mm or less and preferably 500 $\mu$m or less and especially having a true specific gravity of 1.0 g/cm$^3$ or less. However, the inorganic hard balloon is not limited to those materials and any material achieving a similar effect can be preferably used. A blending amount of the inorganic hard balloon is 0.5 to 30 parts by weight and preferably 0.5 to 20 parts by weight based on 100 parts by weight of silicone rubber material.

As for the impact modified resin balloon containing an inorganic filler attached thereon, examples of the inorganic filler to be attached include calcium carbonate, talc, and titanium. However, the inorganic filler is not limited to those materials so long as a strength can be improved, and any material achieving a similar effect can be preferably used.

Preferred example of a thermoplastic resin balloon includes a balloon made of polyvinylidene chloride, polyacrylonitrile, polymethacrylonitrile, polyacrylate, polymethacrylate and copolymer composed of two or more of those polymers, and having a diameter of 1 mm or less and preferably 500 $\mu$m or less and especially having a true specific gravity of 1.0 g/cm$^3$ or less. A blending amount of the thermoplastic resin balloon is 0.5 to 30 parts by weight and preferably 0.5 to 20 parts by weight based on 100 parts by weight of silicone rubber material.

The reason why foaming using a water-absorbing polymer and a hollow filler are employed in combination is as follows. If only an inorganic hollow filler is employed, hardness of the elastic layer 24*b* becomes excessively large. Furthermore, in the case of employing the above-mentioned combination, elasticity of the elastic layer 24*b* is satisfactorily maintained compared to the case of using a water-absorbing polymer only. Therefore, it is preferred that a water-absorbing polymer and a hollow filler be employed in combination.

As for a base material in the elastic layer 24*b* in which a water-absorbing polymer containing an aqueous substance or a mixture of a water-absorbing polymer containing an aqueous substance and a hollow filler is incorporated, any known material used for an elastic layer of a conventional pressure roller can be used. Preferred example of such a material includes silicone rubber and fluoro rubber.

The blending amount of the water-absorbing polymer containing water or of a mixture of the water-absorbing polymer containing water and the hollow filler in the elastic layer 24*b* is not specifically limited so long as the heat conductivity and hardness of the elastic layer 24*b* in the above-mentioned ranges can be obtained. For example, a preferred amount of the water-absorbing polymer can be selected by measuring heat conductivity of the elastic layer 24*b* while varying a content of the water-absorbing polymer and determining the content at which preferred heat conductivity can be obtained. Similarly, a preferred content of water to be blended in the water-absorbing polymer or a preferred blending amount of the hollow filler in the elastic layer 24*b* can be selected.

The elastic layer 24*b* in the present invention can be a laminate in which a foamed elastic layer obtained by heat-curing a rubber composition containing a water-absorbing polymer containing water or a mixture of a water-absorbing polymer containing water and a hollow filler is formed on a layer of another foamed material.

(b) Mold Releasing Layer (Surface Releasing Layer) 24*c*

The mold releasing layer 24*c* can be formed by covering the elastic layer 24*b* with a PFA tube or coating the elastic layer 24*b* with fluoro rubber or fluororesin such as PTFE, PFA or FEP. A thickness of the mold releasing layer 24*c* is not specifically limited so long as sufficient mold releasing property of the pressure roller 24 is obtained. However, the thickness is preferably 20 to 50 μm.

Hardness of the pressure roller 24 is preferably 55° or less and more preferably 50° or less in accordance with measurement using Asker C hardness meter with load of 600 g.

2) Method of Manufacturing Pressure Roller 24

Hereinafter, a method of manufacturing the above-mentioned pressure roller 24 will be described.

(a) As a base polymer, liquid type silicone rubber is preferably used because it is suitable for mold forming and has excellent workability.

The type or the like of the liquid type silicone rubber material is not specifically limited and any silicone rubber, which is in liquid form at an ordinary temperature and is cured by heat to indicate rubber elasticity, can be used.

Examples of the liquid type silicone rubber material include: an addition reaction curing type liquid silicone rubber composition, which is composed of diorganopolysiloxane containing an alkenyl group, organohydrogenpolysiloxane containing a hydrogen atom bonded to a silicon atom, and a reinforcing additive, and is cured by using a platinum type catalyst to be silicone rubber; an organic peroxide curing type liquid silicone rubber composition, which is composed of diorganopolysiloxane containing an alkenyl group and a reinforcing additive, and is cured by using an organic peroxide to be silicone rubber; and a condensation reaction curing type liquid silicone rubber composition, which is composed of diorganopolysiloxane containing a hydroxyl group, organohydrogenpolysiloxane containing a hydrogen atom bonded to a silicon atom, and a reinforcing additive, and is cured by using a condensation reaction promoting catalyst (e.g., organic tin compound, organic titanium compound or platinum type catalyst) to be silicone rubber.

Especially, the addition reaction curing type liquid silicone rubber material is preferred because the material has a rapid curing rate and excellent evenness of a cured product.

It is preferred that viscosity of the composition containing linear diorganopolysiloxane as a main component is 100 centipoises or more at 25° C. in order that the cured product be a rubber elastic material.

Any additives (e.g., various fillers adjusting flowability or improving mechanical strength of the cured product, a pigment, a heat resisting agent, a flame retarder, a plasticizer, or an adhesive agent) can be optionally added to the liquid type silicone rubber material unless an effect of the present invention is deteriorated.

(b) Examples of the water-absorbing polymer include: polyacrylic acid and alkali metal salt thereof, and cross-linked polymer thereof; starch-acrylic acid graft copolymer and alkali metal salt thereof; cross-linked partial sodium salt of polyacrylic acid; and partial sodium salt of starch-acrylic acid graft copolymer. The polymers are commercially available from, for example, Sanyo Chemical Industries Ltd. as SANFRESH series. A particle size at the center of particle size distribution of the water-absorbing polymer in a powder form available from those markets is widely selected in the range of 10 to 800 μm and is preferably 10 to 250 μm, more preferably 10 to 100 μm, and especially preferably 10 to 50 μm.

A blending amount of the water-absorbing polymer is preferably 0.05 to 10 parts by weight based on 100 parts by weight of the liquid type silicone rubber material. If the amount is 0.05 parts by weight or less, sufficient heat insulating property necessary for a pressure roller 24 can not be obtained. If the amount exceeds 10 parts by weight, an open-cell rate of the resultant elastic layer 24*b* is high and therefore mechanical strength of the elastic layer 24*b* is deteriorated.

A content of water to be blended in the water-absorbing polymer is preferably 10 to 300 parts by weight based on 100 parts by weight of the liquid type silicone rubber material.

Then, the water-absorbing polymer in a gel form by addition of water is incorporated into the liquid type silicone rubber material and is agitated to be dispersed therein.

(c) Next, the silicone rubber material is formed by heat-curing to be an elastic layer on the metal core 24*a*. Means and a method of forming a roller by heat-curing are not specifically limited. However, a method of forming a roller including: placing a metal core 24*a* in a pipe-shaped mold having a predetermined inner diameter; injecting the silicone rubber material into the mold; and heating the mold is preferred in view of simplicity.

Here, a heating temperature is preferably 70 to 200° C., more preferably 70 to 150° C., and most preferably 70 to 100° C. Heating time is preferably 10 minutes to 5 hours, more preferably 30 minutes to 3 hours, and most preferably 45 minutes to 2 hours. Selection of an optimum condition of the heating (curing) temperature and time is required because such selection affects an entire foamed cell condition in an inner layer, an outer layer and a longitudinal area of the pressure roller 24.

(d) A secondary heating is performed for evaporating water content in the water-absorbing polymer and for removing reaction residue and unreacted low molecular weight component in the silicone rubber elastic layer to obtain stable properties of the silicone rubber elastic layer after curing. Here, a heating temperature is preferably 150 to 280° C., and more preferably 200 to 250° C. Heating time is preferably 2 to 8 hours, and more preferably 4 to 6 hours.

(e) Finally, a fluororesin tube which forms the mold releasing layer 24*c* and the silicone rubber foamed elastic layer which is the elastic layer 24*b* are laminated by using an adhesive primer to be integrated. In this process, heating is performed to cure the primer.

(4) Evaluation Items

The obtained pressure roller 24 is used and evaluated as a pressure roller 24 in a heat-fixing device 6 (FIG. 2) installed in the above-mentioned image forming apparatus (FIG. 1). Evaluation items and methods in the case are as follows.

(a) Initially, the compression amount y of the pressure roller 24 on which a surface releasing layer 24*b* is formed is measured as follows.

Figure 4A:
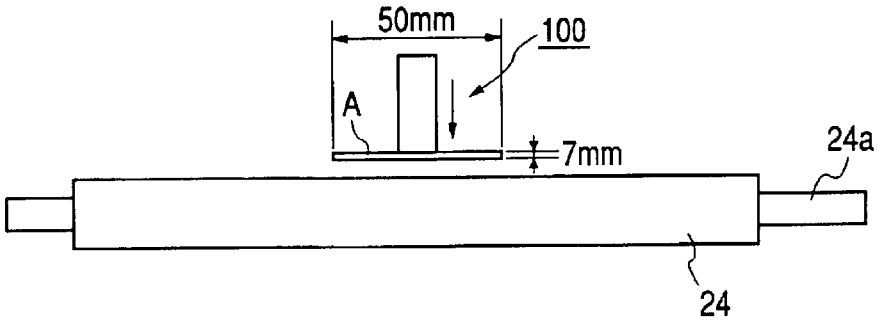
FIGS. 4A and 4B are respectively a schematic view illustrating a compression amount measuring apparatus of a pressure roller.
Figure 4B:
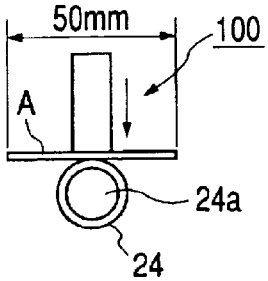

Compression amount y—As shown in FIGS. 4A and 4B, the pressure roller 24 is held by a metal core 24*a* metal at each end of the roller 24. Then, the roller 24 is pressed by a jig 100 having a plate-shaped pressing member A of 50 mm in width, 50 mm in length and 7 mm in thickness at a speed of 80 μm/second. A movement amount of the plate-shaped pressing member A from when a load cell probe begins to detect load to when the probe detects load of 1.4 kg is defined as a compression amount (mm).

(b) Evaluation items are shown in Table 1.

TABLE 1

| Items | | |
|---|---|---|
| 1 | Sheet transporting property | Evaluation of skew feeding |
| 2 | | Evaluation of paper wrinkle |
| 3 | | Evaluation of printing magnification |
| 4 | Film transporting property | Film rupture |

Figure 5:
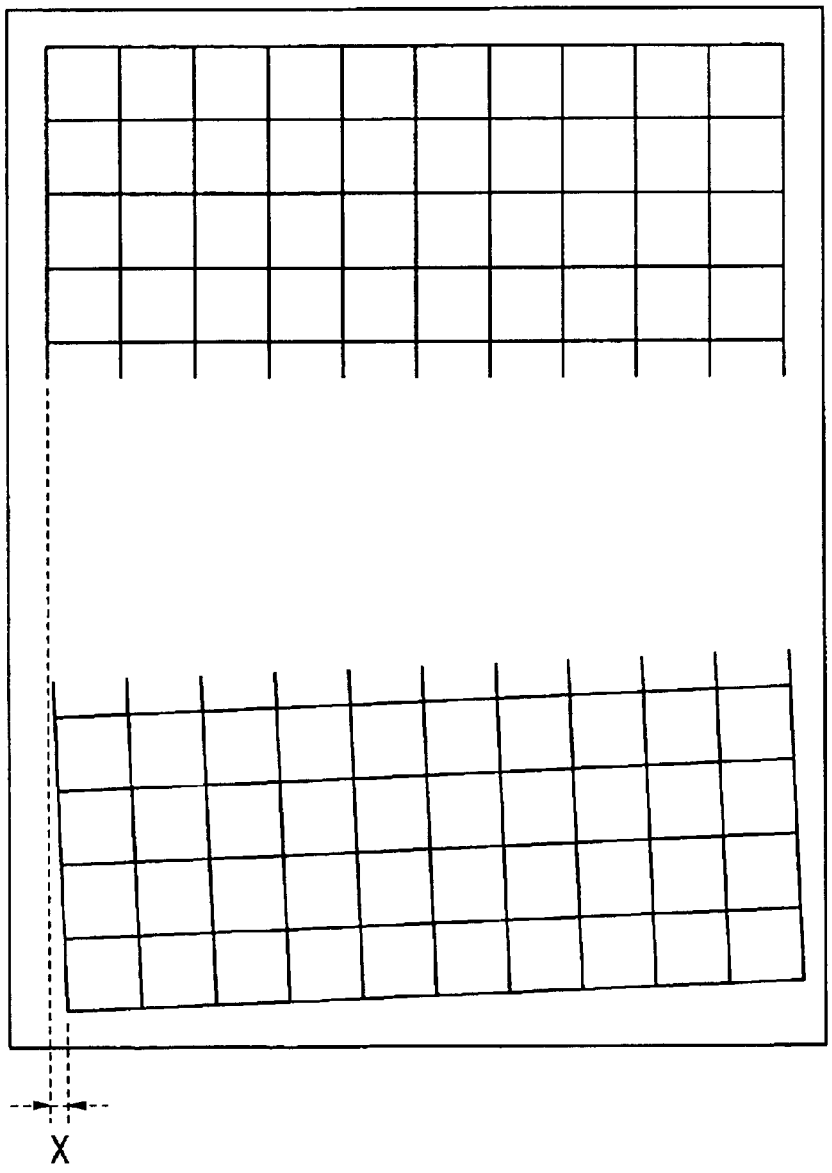
FIG. 5 is an explanatory view showing a skew feeding amount of a recording material.

Evaluation of Skew Feeding:

A grid pattern image having 10 mm in length and 10 mm in width of each grid size is printed on A4 size plain paper (64 g/m$^2$) in which 5 mm blank spaces are set at upper, lower, left and right end portions of the paper respectively (in other words, a grid pattern image corresponding to 280 mm length is printed). A skew feeding amount x is defined as a difference between the very starting printing position of the image (upper-left corner in this embodiment) and the starting printing position of the lower end portion of the image (lower-left corner in this embodiment), as shown in FIG. 5. An average value of 200 sheets after continuously feeding the sheets is obtained.

The result of the above-mentioned evaluation is simply represented as follows.

◎: Excellent ($x<0.2$ mm)

○: Good (0.2 mm$\leqq x<0.4$ mm)

Δ: Acceptable (0.4 mm$\leqq x<0.6$ mm)

×: Bad (0.6 mm$\leqq x$)

Evaluation of Paper Wrinkle:

100 sheets of Steinbeis A4 paper (80 g/m$^2$) were placed for 24 hours or more under high temperature and high humidity condition (32° C./80%). Under such conditions, 100 sheets of Steinbeis A4 paper (80 g/m$^2$) were passed through the apparatus and degree of occurrence of paper wrinkle was evaluated.

The result of the above-mentioned evaluation is simply represented as follows.

◎: Excellent (no wrinkled sheet)

○: Good (less than 3 wrinkled sheets/ignorable wrinkle)

Δ: Acceptable (less than 3 wrinkled sheets/ordinary wrinkle)

×: Bad (3 or more wrinkled sheets/ordinary wrinkle)

Evaluation of Printing Magnification:

A pattern image similar to that in the above-mentioned skew feeding evaluation (corresponding to 280 mm in length) was printed. A distance between the upper end and the lower end on the center portion of the sheet was measured and percentage of the distance was obtained by assuming the pattern image (280 mm in length) to be 100%.

The result of the above-mentioned evaluation is simply represented as follows.

◎: Excellent (99.8% or more)

○: Good (99.6% or more and less than 99.8%)

Δ: Acceptable (99.4% or more and less than 99.6%)

×: Bad (less than 99.4%)

Film Rupture:

150,000-sheets endurance test was performed using A4 plain paper. Rupture of an end portion of a film 23 was observed and the number of ruptured films was obtained.

The result of the above-mentioned evaluation is simply represented as follows.

◎: Excellent (no rupture/no deformation)

○: Good (no rupture/ignorable deformation)

×: Bad (rupture)

(c) Furthermore, evaluations of other properties were performed using the following measuring apparatus or procedure.

Heat conductivity was measured using a Quick Thermal Conductivity Meter QTM-500 (manufactured by Kyoto Electronics Manufacturing Co., Ltd.) and probe PD-13.

An average foamed cell diameter was obtained as follows. 10 foamed portions were selected at random. A value was obtained by the following expression with regard to each foamed portion:

$$(\text{longer diameter}+\text{shorter diameter})/2.$$

An average of the 10 values was calculated to be an average foamed cell diameter.

Surface hardness was measured using Asker C hardness meter (load of 600 g).

(5) EXAMPLE 1

An aluminum material of ϕ14 was used as the metal core 24*a* of the pressure roller 24. The elastic layer 24*b* was formed on the outside of the metal core 24*a* as follows.

In this example, a cell is formed by using a water-absorbing polymer only. In this case, it is preferred that 0.05 to 10 parts by weight of the water adsorbing polymer having an average diameter of 10 to 500 μm in a water-containing state be added to 100 parts by weight of silicone rubber material. Therefore, in this example, 2 parts by weight of a water-absorbing polymer having a particle diameter of 20 to 50 μm in a powder form was used based on 100 parts by weight of an addition reaction type liquid silicone rubber material. A content of water to be blended in the water-absorbing polymer was set to be 80% provided that possible maximum amount which the water-absorbing polymer was capable of absorbing at an ordinary temperature was 100%. By setting the water content at such value, an average diameter of the water-absorbing polymer in a water-containing state was set to be 150 μm.

A primary heat-curing was performed for 1.5 hours at 90° C. and a secondary heat-curing was performed for 4 hours at 220° C. to obtain the silicone rubber elastic layer 24*b* having a thickness of 3 mm.

As an adhesive primer between the silicone rubber elastic layer 24*b* and the fluororesin mold releasing layer 24*c*, an insulation type primer was used. A PFA tube of 30 μm was used for the mold releasing layer 24*c*. A heat-curing at that time was performed for 4 hours at 200° C.

The thus-formed pressure roller 24 had a heat conductivity of 0.125 w/m·k, hardness of 46°, an average foamed cell diameter of 150 μm, and a compression amount of the pressure roller 24 on which a surface releasing layer 24*c* was formed of 0.69 mm.

Several kinds of samples different in compression amount in which hardness of base rubber, and a blending amount, a particle diameter, or the like of the water-absorbing polymer were varied was prepared. Results of evaluations of the sheet transporting property and the film transporting property with regard to such samples are shown in Table 2.

As shown in Table 2, satisfactory results are obtained by setting the compression amount to be 0.8 mm or less. More preferred results are obtained by setting the compression amount to be 0.7 mm or less.

TABLE 2

| | Example 1 | Comparative examination 1 | Comparative examination 2 | Comparative examination 3 |
|---|---|---|---|---|
| Compression amount (mm) | $0.6 < y \leqq 0.7$ | $0.7 < y \leqq 0.8$ | $0.8 < y \leqq 0.9$ | $0.9 < y \leqq 1.0$ |
| Evaluation of skew feeding | ○ | Δ | X | X |
| Evaluation of paper wrinkle | ○ | Δ | X | X |
| Evaluation of printing magnification | ○ | Δ | X | X |
| Evaluation of film rupture | ○ | ○ | X | X |

Generally, a compression amount becomes small when surface hardness of a pressure roller becomes large. In contrast, in the case where the surface layer of the pressure roller is thin or rubber to be used is soft, a general hardness meter cannot detect the difference in impact resilience which is detectable by the sense of touch. Therefore, it is useful to measure a compression amount as in this example.

According to the pressure roller obtained by such a water evaporation method, it is necessary to appropriately adjust and optimize the blending amount and the heating condition to obtain a heat conductivity of 0.15 w/m·k or less as described above. Otherwise, since a temperature of a heater (heat source) does not reach a desired temperature within a predetermined time, deterioration of fixing property would be caused.

Furthermore, it is necessary to appropriately adjust and optimize the blending amount and the heating condition to obtain an average foamed cell diameter of 10 to 500 μm in the elastic layer of the pressure roller. Otherwise, since surface property of the pressure roller is deteriorated, toner contamination would be caused.

Furthermore, it is necessary to appropriately adjust and optimize the blending amount and the heating condition to obtain surface hardness of the pressure roller of 55° or less. Otherwise, since a sufficiently satisfactory fixing nip can not be obtained, deterioration of fixing property would be caused.

The blending amount of the water-absorbing polymer, the content of water in the water-absorbing polymer and the heating condition are not limited to the exemplified values in this example, and can be appropriately adjusted to obtain the heat conductivity, the foamed cell diameter, the hardness, and the compression amount in the above-mentioned range.

The pressure roller proposed in this example is useful regardless of a rotary member opposing the roller and including a heat source. However, the roller in this example is especially useful against a unit employing a low heat capacity film.

(6) EXAMPLE 2

In each of Example 2 and Example 3 described later, a water-absorbing polymer and a hollow filler are used in order to obtain desired heat insulation property. In this case, it is preferred that 0.05 to 10 parts by weight of the water adsorbing polymer having an average diameter of 10 to 500 μm in a water-containing state and 0.5 to 30 parts by weight of the hollow filler having an average diameter of 1 mm or less be added to 100 parts by weight of silicone rubber material. Therefore, in Example 2, a particle diameter of the water-absorbing polymer in a powder form and a content of water to be blended in the water-absorbing polymer were the same as those in Example 1. A blending amount of the water-absorbing polymer was 1 part by weight. Furthermore, 1 part by weight of a glass balloon having a particle diameter at the center of particle diameter distribution of 100 im as a hard hollow filler was incorporated in the silicone rubber composition. A preferred hard hollow filler is one having a diameter of 1 mm or less and preferably 500 μm or less and having a true specific gravity of 1.0 g/cm$^3$. A glass balloon is especially preferred because the balloon has excellent dispersibility in the silicone rubber material and superior gas maintaining property in the balloon. In the case of using the glass balloon, one having an average particle diameter of 200 μm or less and a mean density of 0.1 to 0.6 g/cc is especially preferred because even dispersion of the balloon is relatively easy and a mechanical strength of the balloon is excellent.

In the elastic layer of the obtained pressure roller, there exist a cell (bubble) formed by evaporation of water content from the water-absorbing polymer and a hard hollow filler (glass balloon in this example). The thus-formed pressure roller 24 had a heat conductivity of 0.123 w/m·k, hardness of 46.5°, an average foamed cell diameter of the cell formed by evaporation of water content from the water-absorbing polymer (i.e., except the glass balloon) of 150 μm, and a compression amount of the pressure roller on which a surface releasing layer was formed of 0.57 mm.

By using a combination of foaming by a water evaporation foaming method and the glass balloon, it is possible to reduce the compression amount while the heat conductivity, the hardness and the average foamed cell diameter are equivalent to those in Example 1. In other words, it is possible to improve impact resilience of rubber.

The following can be expected. As described before, since the water evaporation foaming method produces foam having a high open-cell rate, there exist voids in the foam. In this example, since the glass balloon fills a part of the voids, rubber elasticity can be obtained at a portion where rubber elasticity cannot be obtained in the water evaporation method because a cell wall is too thin.

Results of the evaluation are shown in Table 3.

TABLE 3

| | Example 2 | Example 1 | Comparative examination 1 | Comparative examination 2 | Comparative examination 3 |
|---|---|---|---|---|---|
| Compression amount (mm) | y ≦ 0.6 | 0.6 < y ≦ 0.7 | 0.7 < y ≦ 0.8 | 0.8 < y ≦ 0.9 | 0.9 < y ≦ 1.0 |
| Evaluation of skew feeding | ◎ | ○ | Δ | X | X |
| Evaluation of paper wrinkle | ◎ | ○ | Δ | X | X |
| Evaluation of printing magnification | ◎ | ○ | Δ | X | X |
| Evaluation of film rupture | ◎ | ○ | ○ | X | X |

As shown in Table 3, by employing the structure of this example, it is possible to reduce a compression amount without deteriorating other physical properties. Therefore, satisfactory results have been obtained with regard to both of the paper transporting property and the film transporting property.

Similar to Example 1, the deterioration of the fixing property and the contamination of the pressure roller can be prevented by setting the heat conductivity, the averaged foamed cell diameter, and the hardness in the above-mentioned range.

The blending amount of the water-absorbing polymer, the content of water in the water-absorbing polymer, and the heating condition are not limited to the exemplified values in this example, and can be appropriately adjusted to obtain the heat conductivity, the foamed cell diameter, the hardness, and the compression amount in the above-mentioned range.

Similar to Example 1, the pressure roller obtained in this example is useful regardless of a rotary member opposing the roller and including a heat source. However, the roller in this example is especially useful for a unit employing a low heat capacity film.

(7) EXAMPLE 3

The particle diameter of the water-absorbing polymer in a powder form, the content of water in the water-absorbing polymer and the blending amount of the water-absorbing polymer were the same as those in Example 2.

Furthermore, as a hard hollow filler, 1 part of a thermoplastic resin balloon whose surface is coated with calcium carbonate with a particle diameter at the center of particle diameter distribution of 100 μm was mixed in the silicone rubber composition. As the thermoplastic resin for the balloon, acrylonitrile was used.

As for the thus-formed pressure roller 24, the heat conductivity was 0.123 w/m·k, the hardness was 45.5°, the average foamed cell diameter of the cell formed by evaporation of water content from the water-absorbing polymer (i.e., except the resin balloon) was 150 μm, and the compression amount of the pressure roller on which the surface releasing layer was formed was 0.6 μm.

Results of the similar evaluation to the above evaporation in this example are shown in Table 4.

TABLE 4

| | Example 3 Example 2 | Example 1 | Comparative examination 1 | Comparative examination 2 | Comparative examination 3 |
|---|---|---|---|---|---|
| Compression amount (mm) | y ≦ 0.6 | 0.6 < y ≦ 0.7 | 0.7 < y ≦ 0.8 | 0.8 < y ≦ 0.9 | 0.9 < y ≦ 1.0 |
| Evaluation of skew feeding | ◎ | ○ | Δ | X | X |
| Evaluation of paper wrinkle | ◎ | ○ | Δ | X | X |
| Evaluation of printing magnification | ◎ | ○ | Δ | X | X |
| Evaluation of film rupture | ◎ | ○ | ○ | X | X |

Similar to Example 2, satisfactory results were obtained in this example.

Needless to say, satisfactory results can also be obtained by using structure other than that of this example. For example, a combination of a foamed cell obtained by a water evaporation method and mixture of an inorganic hard balloon and a resin balloon whose surface is coated with an inorganic filler can be employed.

Under conditions that the same hardness, heat conductivity and average foamed cell diameter are to be obtained, a compression amount can be reduced approximately in the following order:

(a) the case of using a combination of foaming by a water evaporation method and an inorganic hard balloon, (b) the case of using a combination of foaming by a water evaporation method and a resin balloon whose surface is coated with an inorganic filler, and (c) the case of using foaming by a water evaporation method only.

(8) Other Embodiments of Heating Apparatus

1) FIGS. 6A, 6B, 6C and 6D Show Other Embodiments in Structure of a Heating Apparatus (Heat-Fixing Device) Employing a Film Heating System.

Figure 6A:
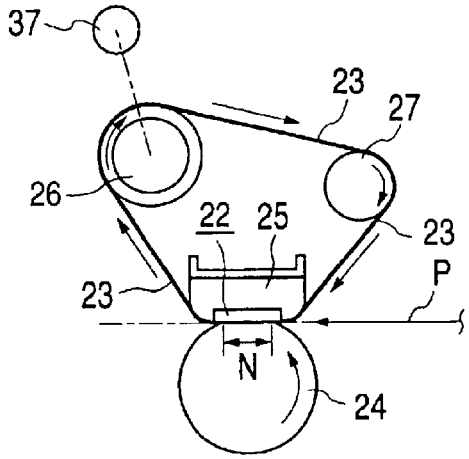
FIGS. 6A, 6B, 6C, and 6D show other embodiments in structure of a heating apparatus (heat-fixing device) employing a film heating system.

An apparatus shown in FIG. 6A includes a heat resistant film 23 having an endless belt shape which is looped around three members, i.e., a heating member 22 held by a heating member holder and film guide member 25, a film driving roller 26, and a tension roller 27 which are arranged substantially in parallel to each other. A press-contacting nip portion N is formed by press-contacting the heating member 22 and a pressure roller 24 while nipping the film 23 therebetween and the film 23 is rotated by the film driving roller 26. The pressure roller 24 is rotated by a rotation of the film 23. Reference numeral 37 denotes a driving source of the film driving roller 26. A transfer material P (as a material to be heated) is introduced to the press-contacting nip portion N and subjected to heat-fixing of a toner image.

Figure 6B:
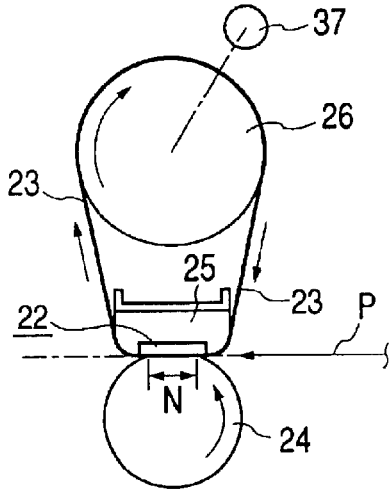

An apparatus shown in FIG. 6B includes the heat resistant film 23 having an endless belt shape which is looped around the heating member 22 held by the heating member holder and film guide member 25, and the film driving roller 26 which are arranged substantially in parallel to each other. The press-contacting nip portion N is formed by press-contacting the heating member 22 and the pressure roller 24 while nipping the film 23 therebetween and the film 23 is rotated by the film driving roller 26. The pressure roller 24 is rotated by the rotation of the film 23.

Figure 6C:
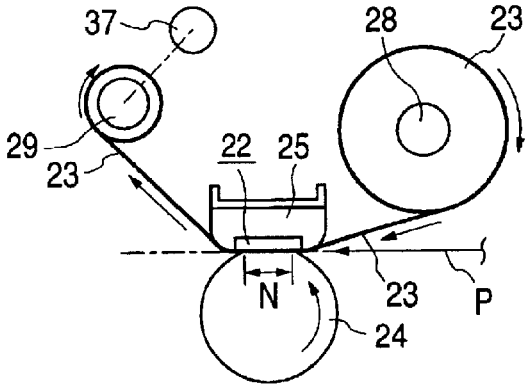

An apparatus shown in FIG. 6C employs a rolled long film having ends as the heat resistant film 23. The film 23 is stretched between a feeding axis 28 and a rolling axis 29 through a lower surface of a heating member 22 held by a heating member holder and film guide member 25. The press-contacting nip portion N is formed by press-contacting the heating member 22 and a pressure roller 24 while nipping the film 23 therebetween. The film 23 is rolled by the rolling axis 29 to be run at a predetermined speed.

Also in an apparatus having the above-mentioned configuration, functions and effects similar to those described above can be obtained by constructing the pressure roller 24 according to the present invention as pressing means.

The heating member 22 on the heating means side is not limited to the above ceramic heater and any suitable heating member such as an electromagnetic (magnetic) induction heating system can be employed.

Figure 6D:
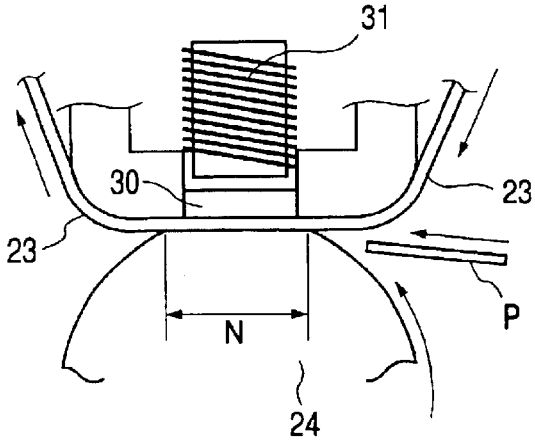

An apparatus shown in FIG. 6D is an example employing the electromagnetic induction heating system. Reference numeral 30 denotes a magnetic metal member which generates heat by electromagnetic induction and reference numeral 31 denotes an exciting coil as means that generates a magnetic field. The magnetic metal member 30 as a heater generates heat by electromagnetic induction by virtue of a high-frequency field generated by feeding a current to the exciting coil 31. The generated heat is applied through the film 23 in the press-contacting nip portion N to the transfer material P (as a material to be heated) which has been introduced to the press-contacting nip portion N. The film 23 itself can be a heat generating member by electromagnetic induction.

Figure 7A:
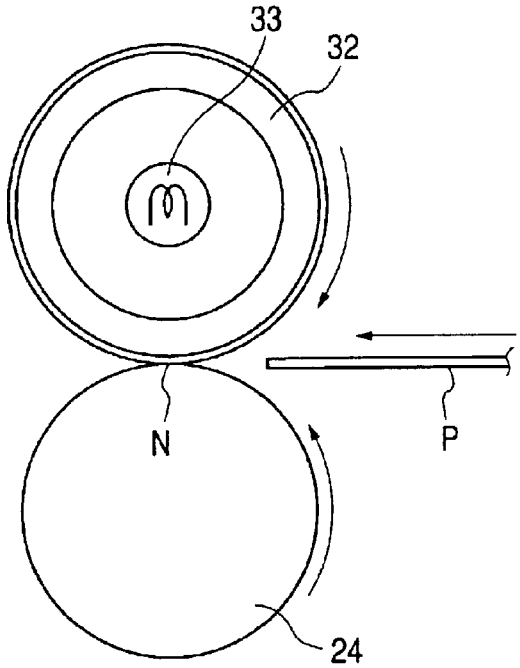
FIGS. 7A and 7B show other embodiments in structure of a heating apparatus (heat-fixing device) employing a heat roller system.
Figure 7B:
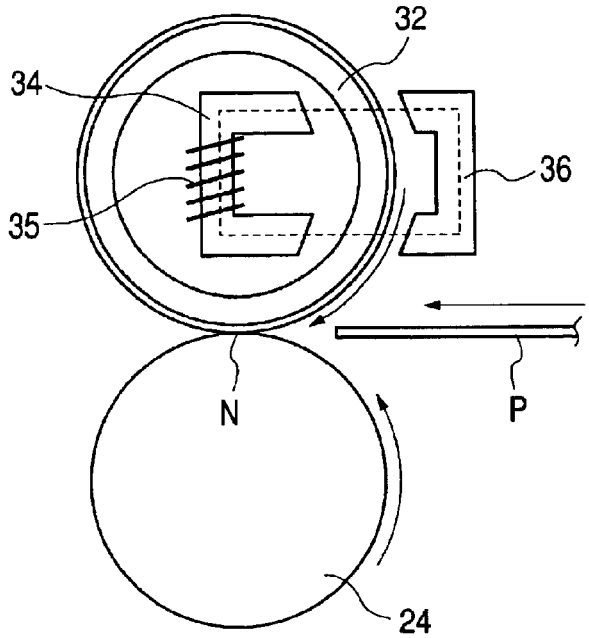

2) FIGS. 7A and 7B Show Other Embodiments in Structure of a Heating Apparatus (Heat-Fixing Device) Employing a Heat Roller System.

In FIG. 7A, reference numeral 32 denotes a heat roller (fixing roller) as heating means, which is a hollow roller made of metal such as iron or aluminum, and a mold releasing layer of fluororesin or the like is formed on an outer peripheral surface of the roller. A halogen heater 33 as a heat source is installed in the roller 32. A press-contacting nip portion N is formed by press-contacting the heat roller 32 and the pressure roller 24. The transfer material P (as a material to be heated) is introduced to the press-contacting nip portion N and is subjected to heat-fixing of a toner image.

An apparatus shown in FIG. 7B is an example employing the electromagnetic induction heating system for heating the heat roller 32. The heat roller 32 is composed of a ferromagnetic material. Heating is performed as follows. A high frequency alternating current is applied to an exciting coil 35 wound on an exciting core 34 to generate a magnetic field, thereby generating an eddy current on the heat roller 32. In other words, a magnetic flux generates the eddy current on the heat roller 32 so that the heat roller 32 itself generates heat (joule heat). Reference numeral 36 denotes an auxiliary core arranged opposing the exciting core 34 through the heat roller 32 to form a closed magnetic circuit.

Also in a heating apparatus employing the above-mentioned heat roller system, functions and effects similar to those described above can be obtained by constructing the pressure roller 24 according to the present invention as pressing means.

To sum up, the present invention is useful for a heating apparatus in which a material to be heated is introduced to a press-contacting nip portion between heating means and pressurizing means and is subjected to heat treatment while the material is being nipped and transported. The heating apparatus can be widely used not only for a heat-fixing device but also for a heating apparatus such as an apparatus for heating a recording material which bears an image to improve surface property (e.g., glossiness), a preliminary fixing device, or an apparatus for feeding a sheet material and drying and laminating the sheet material.

As described above, according to the present invention, it is possible to provide a pressure roller capable of stably transporting a paper and a film without deteriorating inherent rubber elasticity while achieving a low heat conductivity and formation of a finely foamed cell.

Many other modifications will be apparent to and be readily practiced by those skilled in the art without departing from the scope and spirit of the invention. It should therefore be understood that the scope of the appended claims is not intended to be limited by the details of the description but should rather be broadly construed.

What is claimed is:

1. An image heating apparatus for heating an image formed on a recording material, comprising:

a heating member; and a pressure roller forming a nip portion together with said heating member, said pressure roller having an elastic layer and a surface releasing layer, and said nip portion nipping and transporting the recording material, wherein the elastic layer of said pressure roller comprises a foam obtained by heat-curing a rubber composition in which a water-absorbing polymer containing water and a hollow filler are dispersed.

2. An image heating apparatus according to claim 1, wherein said hollow filler comprises an inorganic hard balloon.

3. An image heating apparatus according to claim 2, wherein said hollow filler comprises a glass balloon.

4. An image heating apparatus according to claim 1, wherein said hollow filler comprises a resin balloon whose surface is coated with an inorganic filler.

5. An image heating apparatus according to claim 4, wherein said hollow filler comprises a thermoplastic resin balloon whose surface is coated with calcium carbonate.

6. An image heating apparatus according to claim 1, wherein an average diameter of foamed cells, which are formed by evaporation of water from said water-absorbing polymer, is 10 to 500 $\mu$m.

7. An image heating apparatus according to claim 1, wherein said water-absorbing polymer in a water-containing state has an average diameter of 10 to 500 $\mu$m, and a blending amount of said water-absorbing polymer in the water-containing state is 0.05 to 10 parts by weight based on 100 parts by weight of a liquid rubber material before being cured.

8. An image heating apparatus according to claim 7, wherein said hollow filler has a diameter of 1 mm or less and a blending amount of said hollow filler is 0.5 to 30 parts by weight based on 100 parts by weight of said liquid rubber material.

9. An image heating apparatus according to claim 1, wherein said pressure roller has a compression amount of 0.8 mm or less.

10. A pressure roller used for an image heating apparatus, comprising:

an elastic layer; and a surface releasing layer, wherein said elastic layer comprises a foam obtained by heat-curing a rubber composition in which a water-absorbing polymer containing water and a hollow filler are dispersed.

11. A pressure roller according to claim 10, wherein said hollow filler comprises an inorganic hard balloon.

12. A pressure roller according to claim 11, wherein said hollow filler comprises a glass balloon.

13. A pressure roller according to claim 10, wherein said hollow filler comprises a resin balloon whose surface is coated with an inorganic filler.

14. A pressure roller according to claim 13, wherein said hollow filler comprises a thermoplastic resin balloon whose surface is coated with calcium carbonate.

15. A pressure roller according to claim 10, wherein an average diameter of foamed cells, which are formed by evaporation of water from said water-absorbing polymer is 10 to 500 $\mu$m.

16. A pressure roller according to claim 10, wherein said water-absorbing polymer in a water-containing state has an average diameter of 10 to 500 $\mu$m, and a blending amount of said water-absorbing polymer in the water-containing state is 0.05 to 10 parts by weight based on 100 parts by weight of a liquid rubber material before being cured.

17. A pressure roller according to claim 16, wherein said hollow filler ham diameter of 1 mm or less and a blending amount of said hollow filler is 0.5 to 30 parts by weight based on 100 parts by weight of said liquid rubber material.

18. A pressure roller according to claim 10, wherein said pressure roller has a compression amount of 0.8 mm or less.

19. An image heating apparatus for heating an image formed on a recording material, comprising:

a heating member; and a pressure roller forming a nip portion together with said heating member, said pressure roller having an elastic layer and a surface releasing layer, and said nip portion nipping and transporting the recording material, wherein said elastic layer of said pressure roller comprises a foam obtained by heat-curing a rubber composition in which a water-absorbing polymer containing water is dispersed, and wherein said pressure roller has a compression amount of 0.8 mm or less.

20. A pressure roller used for an image heating apparatus, comprising:

an elastic layer; and a surface releasing layer, wherein said elastic layer comprises a foam obtained by heat-curing a rubber composition in which a water-absorbing polymer containing water is dispersed, and wherein said pressure roller has a compression amount of 0.8 mm or less.

* * * * *

UNITED STATES PATENT AND TRADEMARK OFFICE

CERTIFICATE OF CORRECTION

PATENT NO. : 6,952,553 B2
DATED : October 4, 2005
INVENTOR(S) : Hiroyuki Sakakibara et al.

It is certified that error appears in the above-identified patent and that said Letters Patent is hereby corrected as shown below:

Column 2,
Line 30, “unwillingly” should read -- unintentionally --.

Column 3,
Line 11, after “rubber.”, insert the following as a new paragraph:
-- In the case where a pressure roller having an elastic layer with the deteriorated impact resilience is used as a pressurizing member and a heat roller or a low heat capacity film unit is used as a heating member, an image forming apparatus having a fixing device in which a fixing nip portion is formed by press-contacting both of the members has the following problems:

(1) deterioration of paper transporting property, and (2) rupture of an end portion of a fixing film.

Here, the deterioration of paper transporting property of the item (1) is specifically explained as follows:

(a) paper which is a recording material is transported on the skew, and as a result, an image printed on the skew (in other words, a so-called skew image is formed), (b) a so-called paper-wrinkle image is formed due to a non-uniform paper transporting rate in the fixing nip portion, and (c) a printing magnification is deteriorated due to reduction of a paper feeding ability in a transporting direction. --.

Column 6,
Line 60, “born” should read -- borne --.

Column 10,
Line 36, “can not” should read -- cannot --.

Column 13,
Line 65, “can not” should read -- cannot --.

UNITED STATES PATENT AND TRADEMARK OFFICE

CERTIFICATE OF CORRECTION

PATENT NO. : 6,952,553 B2
DATED : October 4, 2005
INVENTOR(S) : Hiroyuki Sakakibara et al.

It is certified that error appears in the above-identified patent and that said Letters Patent is hereby corrected as shown below:

Column 14,
Line 45, "100 im" should read -- 100 $\mu$m --.

Signed and Sealed this

Fourteenth Day of March, 2006

JON W. DUDAS
*Director of the United States Patent and Trademark Office*